US009670603B2

(12) United States Patent
Brenk et al.

(10) Patent No.: US 9,670,603 B2
(45) Date of Patent: Jun. 6, 2017

(54) DEVICE FOR SHAPING A THREAD-LIKE MATERIAL

(71) Applicant: Saurer Germany GmbH & Co. KG, Remscheid (DE)

(72) Inventors: Siegfried Brenk, Krefeld (DE); Ingo Filz, Viersen (DE); Jurgen Schnitzler, Viersen (DE); Georg Tetzlaff, Aachen (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 402 days.

(21) Appl. No.: 14/557,730

(22) Filed: Dec. 2, 2014

(65) Prior Publication Data

US 2015/0152576 A1 Jun. 4, 2015

(30) Foreign Application Priority Data

Dec. 3, 2013 (DE) ..... 10 2013 020 472

(51) Int. Cl.

| | |
|---|---|
| ***D02G 1/12*** | (2006.01) |
| ***D02J 13/00*** | (2006.01) |
| ***D02G 1/00*** | (2006.01) |
| ***D02J 1/06*** | (2006.01) |

(52) U.S. Cl.

CPC ..... *D02G 1/127* (2013.01); *D02G 1/004* (2013.01); *D02G 1/12* (2013.01); *D02G 1/122* (2013.01); *D02J 1/06* (2013.01); *D02J 13/00* (2013.01); *D02J 13/001* (2013.01)

(58) Field of Classification Search

CPC ..... D02G 1/12; D02G 1/122; D02G 1/127
See application file for complete search history.

(56) References Cited

U.S. PATENT DOCUMENTS

| | | | | |
|---|---|---|---|---|
| 3,298,079 A | | 1/1967 | Agett et al. | |
| 3,600,776 A | * | 8/1971 | Aoki | D02G 1/12 28/269 |
| 3,780,405 A | * | 12/1973 | Izawa | D02G 1/12 28/248 |
| 3,881,230 A | | 5/1975 | Arnold et al. | |
| 3,882,578 A | | 5/1975 | Izawa | |
| 4,554,716 A | | 11/1985 | Nunn | |
| 5,467,513 A | | 11/1995 | Steiner et al. | |

(Continued)

FOREIGN PATENT DOCUMENTS

| | | |
|---|---|---|
| DE | 2 345 299 | 3/1974 |
| DE | 24 59 080 A1 | 7/1975 |

(Continued)

OTHER PUBLICATIONS

German Search Report for Priority German Patent Application No. DE 10 2013 020 472.0, dated Oct. 9, 2014.

(Continued)

*Primary Examiner* — Shaun R Hurley

(74) *Attorney, Agent, or Firm* — Nelson Mullins Riley & Scarborough LLP

(57) ABSTRACT

A device for shaping at least one thread-like material (1), which is formed in a forming unit and is deposited on a transporting device (6) for the subsequent thermosetting process, wherein a retaining means (4, 14, 15, 22) and a drivable, curved depositing tube (5) are arranged one after the other in the thread transporting direction.

9 Claims, 3 Drawing Sheets

(56) References Cited

U.S. PATENT DOCUMENTS

| | | | | |
|---|---|---|---|---|
| 5,483,730 | A | 1/1996 | Hoover | |
| 5,943,748 | A | 8/1999 | Steiner et al. | |
| 6,481,072 | B1 | 11/2002 | Hoover et al. | |
| 7,278,191 | B1 | 10/2007 | Lane et al. | |
| 2005/0102806 | A1 | 5/2005 | Hoover | |
| 2014/0087912 | A1* | 3/2014 | Willson | D07B 7/06 475/298 |

FOREIGN PATENT DOCUMENTS

| | | | |
|---|---|---|---|
| DE | 198 25 905 | A1 | 3/1999 |
| WO | 2008/154013 | A1 | 12/2008 |
| WO | 2012/096799 | A1 | 7/2012 |

OTHER PUBLICATIONS

European Search Report issued in corresponding European Application No. 14003924.9, dated May 8, 2015.

* cited by examiner

DEVICE FOR SHAPING A THREAD-LIKE MATERIAL

CROSS-REFERENCE TO OTHER APPLICATIONS

This application claims priority from German National Patent Application No. 10 2013 020 472.0, filed Dec. 3, 2013, entitled "Vorrichtung zur Formgebung eines Fadenformigen Gutes," the entire contents of which is incorporated herein by reference.

FIELD OF THE INVENTION

The invention relates to a device for shaping at least one thread-like material, which is formed in a forming unit and is deposited on a transporting device for the subsequent thermosetting process.

BACKGROUND OF THE INVENTION

So that textiles fulfill their purpose of use and have the desired properties with respect to feel, appearance and use behavior, they are specially processed. Apart from obtaining the fiber, yarn and twist production and fabric production, there are further methods, which influence the textile properties.

Depending on the purpose of use, for example, a greater stability, a higher temperature resistance or more volume are desired in the thread-like material.

These properties are achieved by so-called finishing methods, which can be carried out in all the process stages. There are finishing methods for fibers, yarns/twists and fabrics. Some finishing methods can be integrated in the production or further processing process, but others are in turn discontinuous.

Many of these finishing methods require a subsequent thermal setting, which is generally carried out in a steam atmosphere or under dry heat in order to permanently stabilize the desired properties. The setting process is generally called thermosetting in the textile industry but the synonym heat-set process is used in the area of carpet yarn production.

In the area of carpet yarn production, for example, there are so-called straight set yarns and frieze yarns.

In the case of straight set yarn, the straight linear structure of the single yarns or the cabled yarns or twists is thermoset, which leads to straight pile loops arranged next to one another in cut-pile carpets.

A three-dimensional formation is imposed on the yarn in a separate process for frieze yarns between the cabling process and the heat-set process. In this case, the yarn is three-dimensionally formed by bending/compression and this state is thermoset. The yarns are formed like a walking stick in the finished carpeting in the case of cut-pile carpets. The carpets exhibit a lively surface structure, which is non-sensitive to footprints. More than half the cabled yarns or twists processed in cut-pile tufted carpets worldwide are given a so-called frieze appearance or textured appearance in a thermo-mechanical process.

After forming, the cabled yarns or twists are subjected to a subsequent thermosetting process. Owing to the successive heating and cooling, the yarn relaxes and, depending on the type of material, may shrink and bulk. Furthermore, the yarn twist is permanently stabilized or set thereby, which, in later use of the yarns, leads to substantially improved wear-resistance and durability of the carpets or carpeting produced therefrom.

In practice these methods are carried out by single units that are independent of one another.

A method and a device for thermosetting carpet yarn using different yarn depositing mechanisms is disclosed by U.S. Pat. No. 5,467,513. Furthermore, the device and the method are to be able to modify existing thermosetting machines in such a way that the most varied yarns from straight set yarn to highly crimped yarn can be produced.

This is to be achieved by a yarn depositing system for depositing the yarn in predetermined laying patterns on a conveyor belt. The yarn is then transported on the conveyor belt through the thermosetting mechanism. The yarn depositing is controlled by different laying patterns in such a way that yarns textured to different extents can be produced.

A controllable, oscillating yarn delivery tube for depositing the yarn in different laying patterns on the conveyor belt is configured in such a way that a change can be made between the straight set yarn production and the texturing of the yarn. The drive motor of the oscillating yarn delivery tube is correspondingly controlled for this purpose. Moreover, an adjustable baffle plate is additionally arranged above the conveyor belt so the yarn, which exits from the yarn delivery tube, firstly impacts on the baffle plate and is then deposited on the conveyor belt. In order to assist the drawn transportation of the yarn to the exit of the yarn delivery tube, compressed air is fed to the yarn delivery tube through an injection nozzle.

The drawback in the method and the device is that the texturing by means of predetermined laying patterns is firstly produced during the depositing on the conveyor belt. However, it has been found in practice that a random production of the textured effect brings about a livelier surface structure of the yarns in the finished carpet. In addition, not all the yarn counts can be equally formed with the loop depositor, and above all narrow limits are imposed in the case of coarser yarn counts with this device. Because of this knowledge, both the method and the device according to US Pat. No. 5,467,513 have not been accepted in practice.

A thread finishing system is described in German Patent Publication DE 198 25 905 A1. Depending on whether a crimped or uncrimped thread is to be produced, the latter runs through a corresponding alternatively used unit and is deposited on a conveyor belt. On the conveyor belt, the thread is finally fed to an air-conditioning chamber for thermosetting. As different units are used for producing crimped or uncrimped threads, an adapter arranged downstream of the delivery roller pair is disclosed, which reduces the assembly outlay for converting the finishing system.

According to German Patent Publication DE 198 25 905 A1, in order to be able to produce crimped threads (in the textile area, the terms compressed, formed threads or threads with a frieze effect are used as synonyms), a so-called compression chamber is used. The compression chamber, apart from a channel inlet and a channel outlet, has a through-channel A so-called retaining flap is arranged on the channel outlet, with a joint on the channel wall, said retaining flap exerting a retaining force counter to the transporting direction of the threads to be compressed. The threads to be compressed reach the through-channel via the channel inlet and are braked here on the walls of the through-channel and by the retaining flap until the yarn plug is so large that the retaining force of the retaining flap is overcome and the threads come to rest on the conveyor belt via a sliding face arranged downstream of the channel outlet. Following this, the threads are fed on the conveyor belt to a separate thermosetting mechanism.

If, on the other hand, uncrimped threads or straight set yarns or twists are to be produced, a so-called loop depositor is necessary for this. The loop depositor contains a hollow shaft, into which a depositing tube projects. Together with the hollow shaft, the depositing tube can be driven to traverse. The threads, which are fed by the delivery roller pair, arrive through an inlet tube in the through-channel and finally in the channel of the traversing depositing tube, so the threads are deposited in the form of thread loops on a conveyor belt in order thereafter to run through a separate thermosetting mechanism. Ignoring the bending radii, uncrimped or straight set threads are referred to.

However, it is a drawback in the devices that to achieve the frieze or straight set effect, individual units are used, so to change from one effect to the other, it is necessary to convert mechanical components and to rethread the thread-like material, which leads to downtimes of the textile machine and impairs productivity.

SUMMARY OF THE INVENTION

It is therefore an object of the present invention to propose a device, which is flexible with respect to the selection of the effect and reduces productivity losses when changing the treatment.

This object is achieved according to the invention by providing a retaining means and a drivable, curved depositing tube that are arranged one after the other in the thread transporting direction.

So that when changing from straight set yarns to frieze yarns or vice versa, the corresponding effect device does not always have to be disassembled, exchanged and installed again, a device is used here, with which both frieze yarns, i.e. yarns with a three-dimensional shaping, and straight set yarns, i.e. yarns in the elongated state, can be produced.

In this manner, the change from one effect to the other is simplified and production may take place in a more flexible manner and more oriented to requirements. The machine no longer has to be shut down during the conversion and rethreading becomes superfluous.

Tubes generally have a circular cross section but in the framework of the invention, the depositing tubes may also have any other cross section, such as, for example, rectangular, oval or open at the top as a trough.

Basically, the intensity of the frieze character, i.e. the intensity of the three-dimensional formation performed in the yarn plug, can be influenced by the level of the retaining flap resistance against its pivoting.

Thread-like material in the framework of this application is to mean all linear fabrics. These may be yarns, twists but also film tapes as well as tubular and tape-like textiles and the like.

The device may be operated self-sufficiently or be integrated in the thread run of thread production processes or thread processing processes. The device is particularly suitable for finishing carpet yarns. Therefore, in particular, the device according to the invention can be integrated in the thread run of cabling or twisting machines An arrangement, for example in front of a tufting machine, after an extruder or integrated in another textile machine processing thread-like material, would also be conceivable.

The device can be used for single threads. However, it is also possible for a thread sheet to be transported into the device to achieve an effect.

In particular, either a switching element at the workstation or a central adjusting mechanism may be present to select the alternative operating positions for producing straight set or frieze yarn.

At the workstation, a switch can thus be made easily and without expenditure of time between the different effects by means of pressing a button or, for example, by means of a lever. If a frieze yarn was hitherto produced and the switching element actuated, the retaining flap is placed on the inner wall of the compression chamber and locked there. At the same time, the depositing tube is optionally driven.

If, on the other hand, a change is made over to the frieze yarn, the retaining flap pivots into the thread path and a drive for the depositing tube can be dispensed with.

It may, however, be the case that the selection as to whether a frieze or straight effect is to be achieved and to what degree the frieze effect is formed, is adjusted in the central control unit. For this, a shaft along the length of the machine with cam discs may be used, for example, which shaft then activates the devices of the individual workstations.

In a preferred embodiment, the retaining means is configured as at least one pivotable retaining flap.

In this case, the thread is conveyed by the delivery mechanism into the compression chamber, in which the retaining flap is placed and closes the space. This can be achieved by a single retaining flap or by the interplay of two or more retaining flaps, the retaining flap force being produced by means of a force loading, such as, for example, spring-loaded or pneumatically loaded. A thread plug is formed on the retaining flap, which, as soon as the plug pressure exceeds the counter-force of the retaining flap, leaves the compression chamber again. The level of the retaining flap resistance determines the intensity of the three-dimensional forming formed in the plug in this case, i.e. the intensity of the frieze character.

The retaining flap can either pivot back here to the wall of the compression chamber or the pivoting path of the retaining flap is limited by an adjustable maximum opening of the retaining flap. Not only can the compression chamber volume be adjusted in this manner, but also the maximum filling quantity of the compression chamber, which ultimately affects the intensity of the forming.

A further possible variant is that the retaining flap is not pivoted back, but adjusted in such a way that a degree of opening of the retaining flap is retained and the thread plug leaves the compression chamber through this passage thus obtained.

According to another feature of the device, the retaining means is configured as a side wall of the depositing tube.

As an alternative to the retaining flap, the frieze effect can also be produced in that the material piles up at a suitable point and the yarn plug forms. The piling up takes place purely due to friction; the yarn piles up on the base of the depositing tube until a yarn plug builds up. As soon as the frictional resistance has been overcome, this yarn plug slides out of the depositing tube in the direction of the transporting device and is placed thereon. With continuous further conveyance, a continuous frieze production develops.

In accordance with another aspect of the invention, the at least one retaining flap can alternatively be operated as a frieze mechanism or can be locked in a position pivoted back from the thread path.

To produce the frieze effect, the retaining flap of the compression chamber is pivoted into the thread path.

When changing to the production of straight set yarn, the retaining flap is locked in a rear position and remains there for the entire production time. A more or less obstacle-free chamber, through which the thread runs without deflection, is thus produced from the compression chamber.

According to another feature of the device, the depositing tube is alternatively driven or fixed in an angular position allowing the depositing of the thread material on the transporting device.

When producing the frieze effect, the formed yarn is deposited in a controlled manner by means of the depositing tube, the outlet opening of which points in the direction of the transporting mechanism and which is either fixed or driven. In this case, the frieze yarn formed slides down under its own weight and as a result of the continuous replenishment in the interior of the depositing tube and is placed on the transporting mechanism.

In the straight set yarn production, the depositing tube is driven in such a way that the thread is deposited on the transporting device arranged in an arc of a circle shape.

The depositing tube can preferably be driven in a rotatable manner or in an oscillating manner.

In straight set yarn production, the depositing tube is driven in a rotatable or oscillating manner by means of a drive, for example a stepping motor. The thread is thus hurled outwardly, coming from the delivery mechanism, by means of the centrifugal force effect being produced and runs drawn within the compression chamber. With the combination of centrifugal force and the thread's own weight, the thread is placed on the conveying device, arranged in an arc of a circle shape.

It was found by means of tests that in some cases, a suitable depositing also takes place with a stationary depositing tube. The yarn is then also placed in arcs under its own weight. This is also possible according to the invention, but the yarn depositing can then not be adapted and controlled.

System parameters, such as, in particular, the retaining force of the retaining flap, the opening degree of the retaining flap or the speed of the depositing tube, can particularly preferably be adjusted.

The system parameters, such as, for example, the retaining force of the retaining flap or the speed of the depositing tube, can either be adjusted at the central control unit or locally at the respective workstation computers. This also includes the selection of whether the retaining flap is used pivoting intermittently or is adjusted to a specific opening degree. It is thus possible to adjust the system to material-specific special features and to thus be able to process/produce the most varied materials and differently highly formed yarns.

According to another feature, means are provided to automatically thread the thread-like material.

In order to simplify handling, automatic threading, for example by means of compressed air, is provided.

BRIEF DESCRIPTION OF THE DRAWINGS

The invention will be described in more detail below with the aid of an embodiment shown in the drawings, wherein.

DETAILED DESCRIPTION OF THE INVENTION

Figure 1:
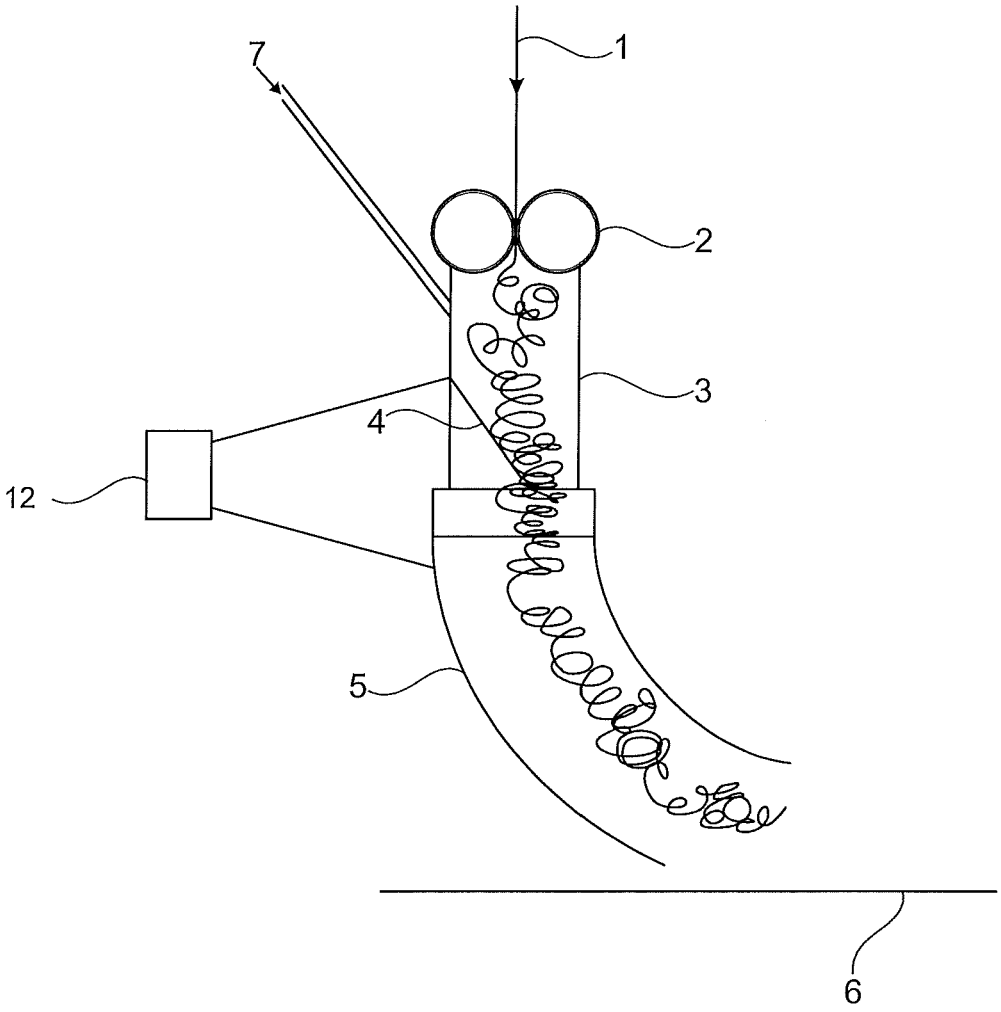
FIG. 1 shows a schematic view of the device according to the invention.

FIG. 1 schematically shows the device according to the invention, with which both the frieze and the straight set effect can be achieved.

The thread 1 is conveyed continuously into a compression chamber 3 by means of a delivery mechanism 2 and is pressed at the exit against a spring-loaded retaining flap 4, which closes the exit of the compression chamber 3. By means of the mechanical backup pressure in the compression chamber 3, the thread 1 is three-dimensionally bent and/or kinked (crimped) in a geometrically irregular manner. The forming of the thread 1 can be assisted by hot air or steam flow into the compression chamber 3; for this purpose, the device has a corresponding inlet 7.

The thread sheet crimped in the compression chamber 3, also called a stuffer box, forms a thread plug against the force-loaded retaining flap 4, which plug, as soon as the plug pressure exceeds the counter-force of the retaining flap 4, leaves the compression chamber 3 again. The level of the retaining force resistance determines here the intensity of the three-dimensional forming formed in the plug, i.e. the intensity of the frieze character. The frieze character is influenced by means of changing the retaining flap force. By means of an adjusting device, e.g., a wheel with a scale to activate a torsional spring the axis of the retaining flap 4 can be acted upon to loads the retaining flap 4 in the opposite direction.

The depositing tube 5 ensures the controlled depositing on a conveyor belt 6. In other words, from the compression chamber 3, the thread 1 runs through a depositing tube 5, the outlet opening of which is fixed and points in the direction of the conveyor belt 6. The frieze yarn formed slides down under its own weight and as a result of the continuous replenishment in the interior of the depositing tube 5 and is placed on the conveyor belt 6.

When producing straight set yarn, by actuating a switching element 12, which may comprise a lever, the retaining flap 4 is locked, for example by means of a magnet, on the inner wall of the compression chamber 3. At the same time, the lever switches the stepping motor 8 of the depositing tube 5 on. Thus, the retaining flap 4, which is attached by a joint on the wall of the compression chamber 3, is locked in the rear position and remains there for the entire production time. The compression chamber 3 has thus become a guide without an obstacle for the thread 1 that is running through. At the same time, the depositing tube 5 is rotatably driven. The thread 1 is thus hurled outwardly, coming from the delivery mechanism 2, by means of the centrifugal force effect being produced and runs drawn within the compression chamber 3. With the combination of centrifugal force and the thread 1's own weight, the thread 1 is deposited on the conveyor belt 6 arranged in an arc of a circle shape.

Figure 2A:
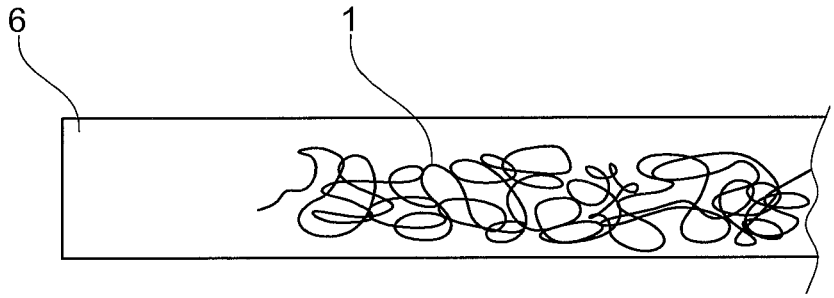
FIG. 2*a*-2*d* show schematic views of the thread depositing for the combined frieze/straight set mechanism.

As can be seen from FIG. 2*a*, the formed thread sheet is deposited in an unordered state on the conveyor belt 6 in the case of frieze yarn production with an upright depositing tube 5.

Figure 2B:
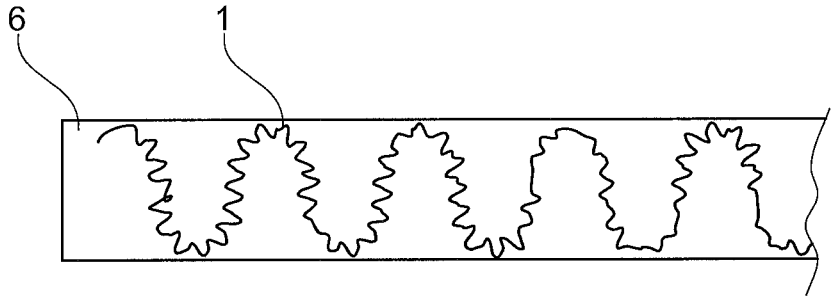

If the depositing tube 5 is, on the other hand, driven in an oscillating manner during the frieze yarn production, the thread deposit as shown in FIG. 2*b* is produced.

Figure 2C:
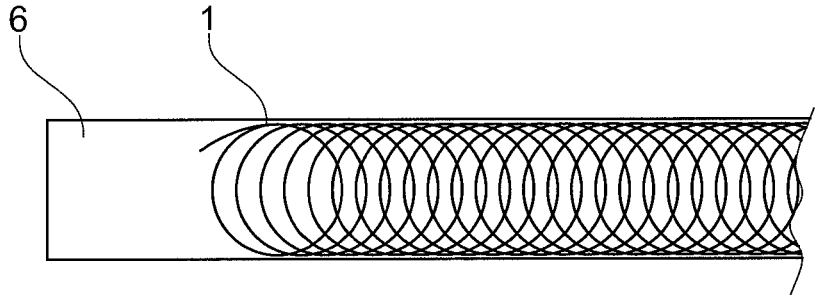

FIG. 2*c* shows an arc of a circle deposit, as takes place in the case of the straight set yarn production with a rotating depositing tube 5. The depositing radius, which is influenced by the level of the centrifugal force, the threads 1's own weight and the conveyor belt speed, is adjusted to be so great that the arc of a circle characteristic is still represented as virtually straight in the yarn tufts of the finished carpet.

Figure 2D:
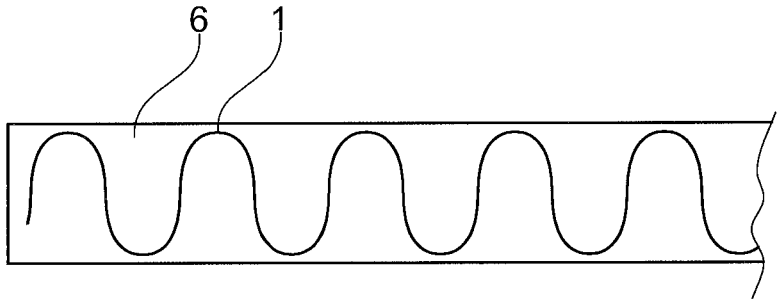

If the depositing tube 5 is driven in an oscillating manner instead of a rotatable manner during the straight set yarn production, the thread depositing takes place as depicted in FIG. 2*d*.

Figure 3:
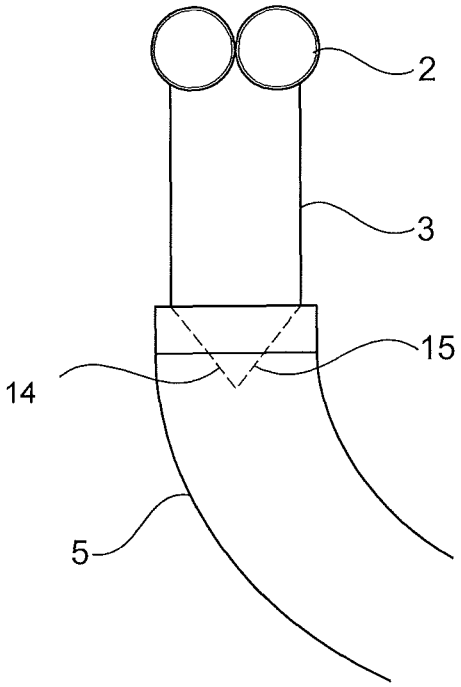
FIG. 3 shows an alternative embodiment of the device according to the invention.
Figure 4:
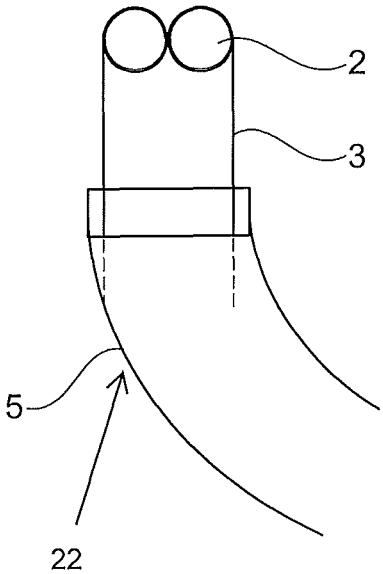
FIG. 4 shows a further alternative embodiment of the device according to the invention.

FIGS. 3 and 4 show different embodiments of the device according to the invention. As the basic principles are the same in the different embodiments and in order to avoid repetition, things are only dealt with at this point where the embodiments differ.

In FIG. 3, two retaining flaps 14, 15 are attached on the compression chamber. Coming from the delivery mechanism 2, the thread 1 arrives in the compression chamber 3. In the frieze yarn production, the thread 1 piles up on the two retaining flaps 14, 15. To produce straight set yarn, the two retaining flaps 14, 15 are adjusted into an open position, locked and the depositing tube is driven in an oscillating manner.

FIG. 4 shows a compression chamber 3 without a retaining flap. Nevertheless, the frieze effect can also be produced using this embodiment according to the invention of the device. For this purpose, the compression chamber 3 is configured in such a way that it reaches into the depositing tube 5. The thread 1 piles up on the side wall 22 or on the base of the depositing tube 5. As soon as the frictional resistance has been overcome, the yarn plug slides out of the depositing tube 5 onto the conveyor belt. To produce the straight set effect, the depositing tube 5 is driven and the thread 1 coming from the delivery mechanism 2 is deposited in arcs on the transporting device.

The present invention has been herein described in relation to an exemplary embodiment or embodiments for purposes of providing an enabling disclosure of the invention. However, it will be understood by persons skilled in the relevant art that the present invention is susceptible of a broader utility and application. Accordingly, it is to be expressly understood that the present invention is not to be construed as limited to the embodiments, features and aspects herein described, but only according to the appended claims.

The invention claimed is:

1. Device for shaping at least one textile strand material (1), which is formed in a forming unit and is deposited in an untensioned state on a transporting device (6) for a subsequent thermosetting process, characterised in that a retaining means (4, 14, 15, 22) and a drivable, curved depositing tube (5) are arranged one after the other in the strand transporting direction, wherein the device is alternatively switchable between a straight set or frieze production modes.

2. Device according to claim 1, characterised in that a switching element (12) is present at the workstation to select the alternative operating positions to produce straight set or frieze yarn.

3. Device according to claim 1, characterised in that the retaining means is configured as at least one pivotable retaining flap (4, 14, 15).

4. Device according to claim 1, characterised in that the retaining means is configured as a side wall (22) of the depositing tube (5).

5. Device according to claim 3, characterised in that the at least one retaining flap (4, 14, 15) can alternatively be operated as a frieze mechanism or can be locked in a position pivoted back from the strand path.

6. Device according to claim 1, characterised in that the depositing tube (5) is alternatively driven or is fixed in an angular position allowing the depositing of the strand material on the transporting device (6).

7. Device according to claim 6, characterised in that the depositing tube (5) can be rotatably driven.

8. Device according to claim 6, characterised in that the depositing tube (5) can be driven in an oscillating manner.

9. Device according to any claim 1, characterised in that the retaining force of the retaining flap (4, 14, 15), the opening degree of the retaining flap or the speed of the depositing tube (5), can be adjusted.

* * * * *